United States Patent [19]

Derr

[11] Patent Number: 4,548,457

[45] Date of Patent: Oct. 22, 1985

[54] ZERO MATING FORCE TERMINAL HAVING WIPING ACTION

[75] Inventor: Paul B. Derr, Middletown, Pa.

[73] Assignee: AMP Incorporated, Harrisburg, Pa.

[21] Appl. No.: 605,511

[22] Filed: Apr. 30, 1984

[51] Int. Cl.[4] ..... H01R 13/11

[52] U.S. Cl. ..... 339/88 R; 339/47 C; 339/258 R

[58] Field of Search ..... 339/217 S, 223 R, 88 R, 339/47 R, 47 C, 256 R, 256 SP, 258 R, 258 P, 258 S, 258 F

[56] References Cited

U.S. PATENT DOCUMENTS

| | | | |
|---|---|---|---|
| 3,115,379 | 12/1963 | McKee | 339/47 |
| 3,169,814 | 2/1965 | Collins | 339/47 R |
| 3,259,869 | 7/1966 | Batcheller | 339/47 |
| 3,665,378 | 5/1972 | Hammell et al. | 339/217 S |
| 3,725,840 | 4/1973 | Hesse | 339/88 R |

FOREIGN PATENT DOCUMENTS

| | | | |
|---|---|---|---|
| 1197950 | 8/1965 | Fed. Rep. of Germany | 339/256 SP |
| 1166130 | 10/1969 | United Kingdom | 339/256 SP |

*Primary Examiner*—John McQuade
*Attorney, Agent, or Firm*—Adrian J. LaRue

[57] ABSTRACT

A pair of zero insertion force terminals having a wiping action include a first terminal having a blade with a pair of oppositely directed embossments and a second terminal with a pair of cantilever arms. The terminals are normally mated with their planes thereof perpendicular to each other and then are relatively rotated about their longitudinal axes to bring the arms into a loaded engagement with said embossments causing a loaded sliding action towards an unmating condition to effect relative wiping action therebetween.

14 Claims, 9 Drawing Figures

28
38
42
40
32
22
26
34
18
36
48
30
50
52
54
16
44
46
58
56
24
12
20
72
74
76
72
64
68
74
76
66
60
78
70
62

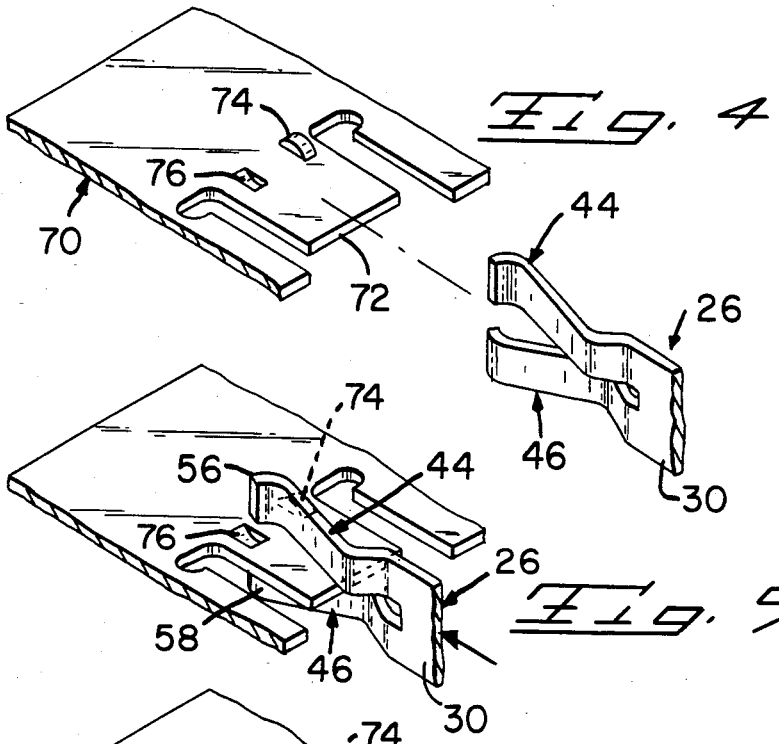
Fig. 4
Fig. 5
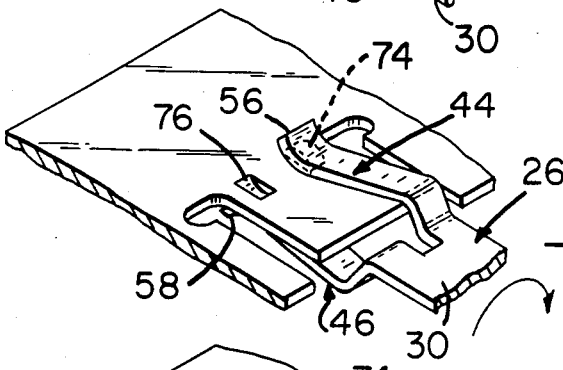
Fig. 6A
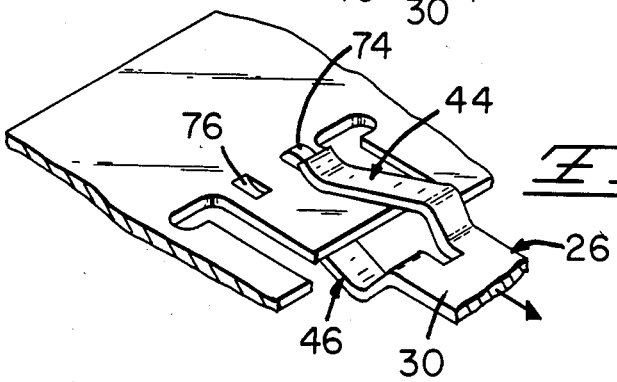
Fig. 7A

ZERO MATING FORCE TERMINAL HAVING WIPING ACTION

The present invention is related to an improved electrical terminal which has zero mating force and yet has a wiping mating action.

There are many well-known electrical terminals which have a pair of closely spaced, offset tines which interengage with like tines of a mating terminal. Examples of this type of terminal can be found in U.S. Pat. Nos. 3,115,379 and 3,259,869. While these terminals have a wiping action during mating, they also generally require rather high mating forces. One effect of this high mating force is reduced life of such terminal, particularly if the terminal is plated.

The present invention overcomes this difficulty of the prior art by producing an electrical terminal formed by a pair of parallel spaced, laterally offset tines which receive therebetween a blade member substantially normal to the tines, the terminal subsequently being rotated about its longitudinal axis to resiliently engage opposite sides of the blade member with end portions of the tines engaging and riding down a ramp to the ultimate mated position.

The present invention will now be decribed by way of example with reference to the accompanying drawings in which:

FIG. 4 is an exploded fragmentary perspective view of the subject invention in an unmated condition;

FIG. 5 is a view similar to FIG. 4 showing the initial engagement of the terminals of the present invention;

FIG.6A is a perspective view of the present invention in an intermediate phase of the engagement;

FIG. 7A is a perspective view of the subject invention in the final mated position.

Figure 1:
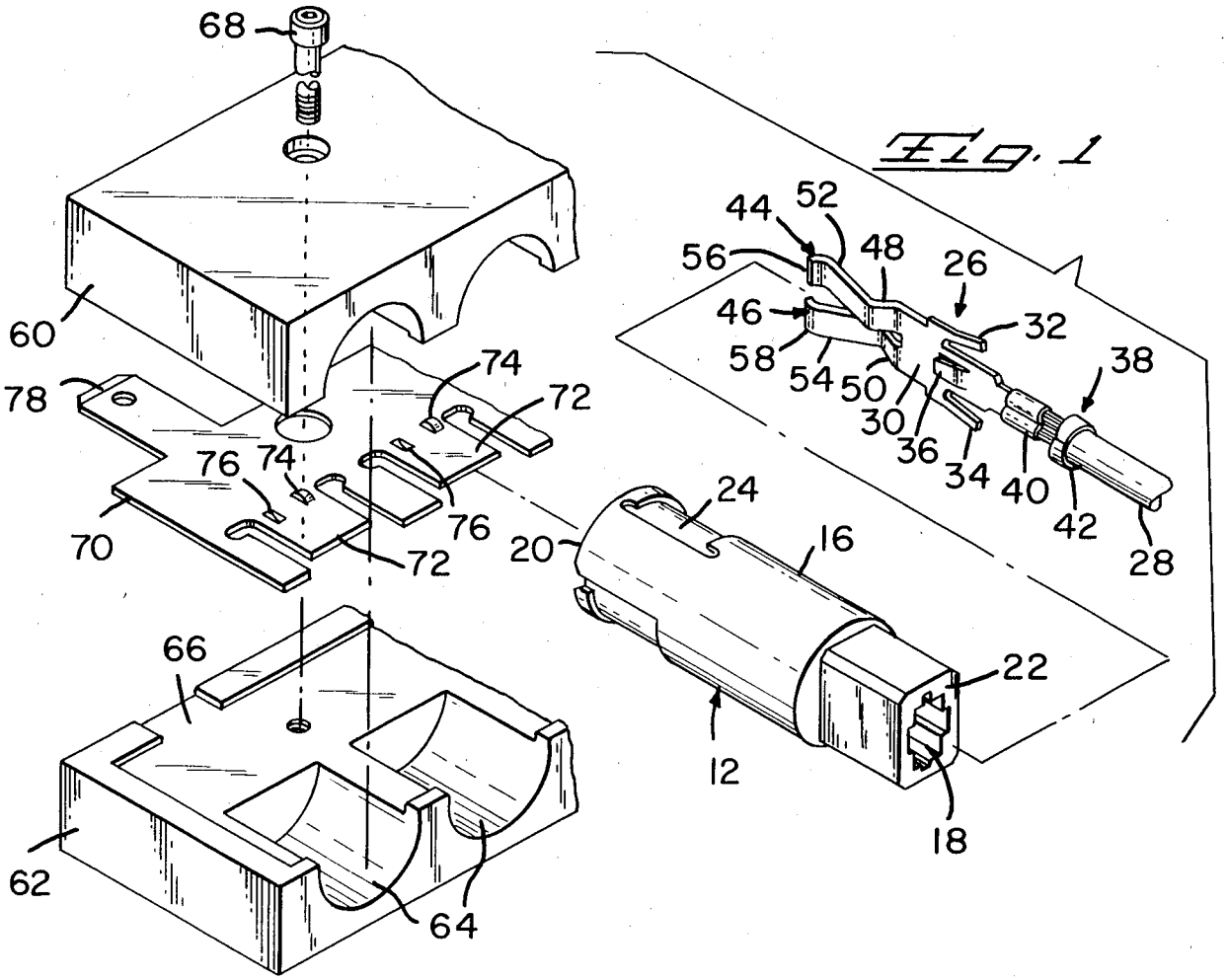
FIG. 1 is an exploded perspective view of an electrical connector embodying the present invention.
Figure 2:
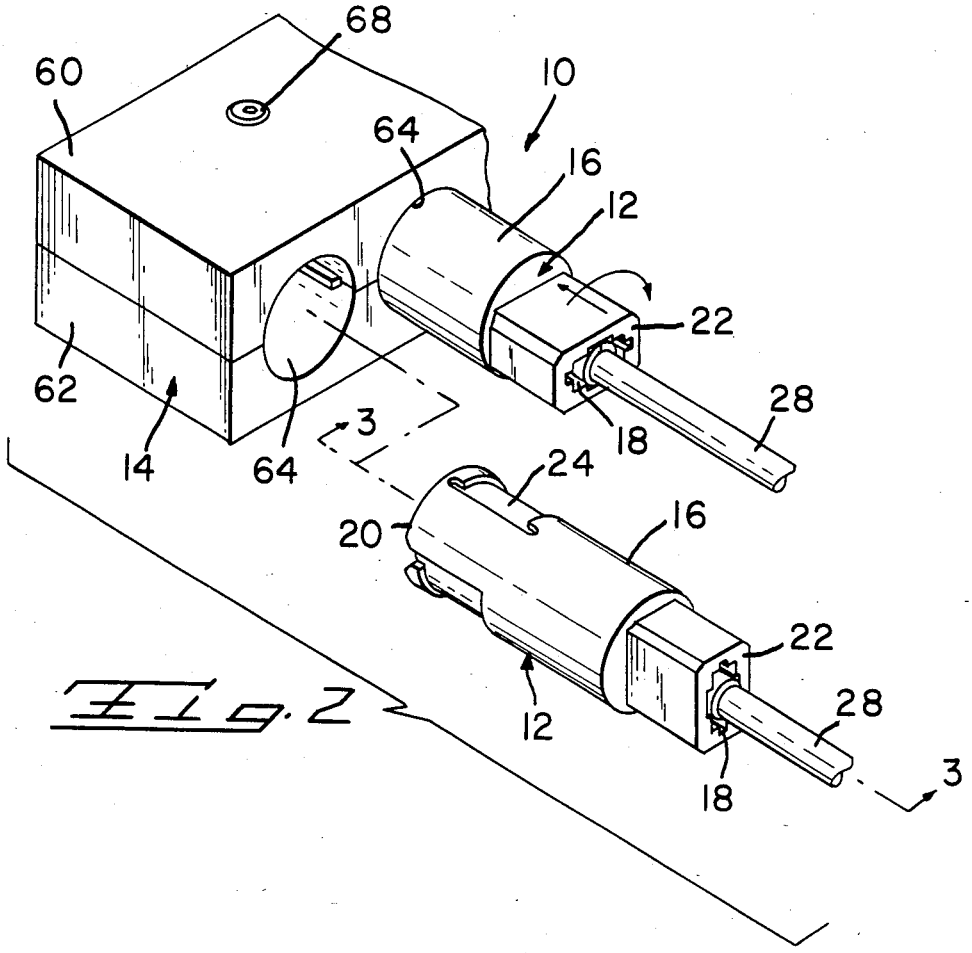
FIG. 2 is a perspective view of the connector illustrated in FIG. 1.
Figure 3:
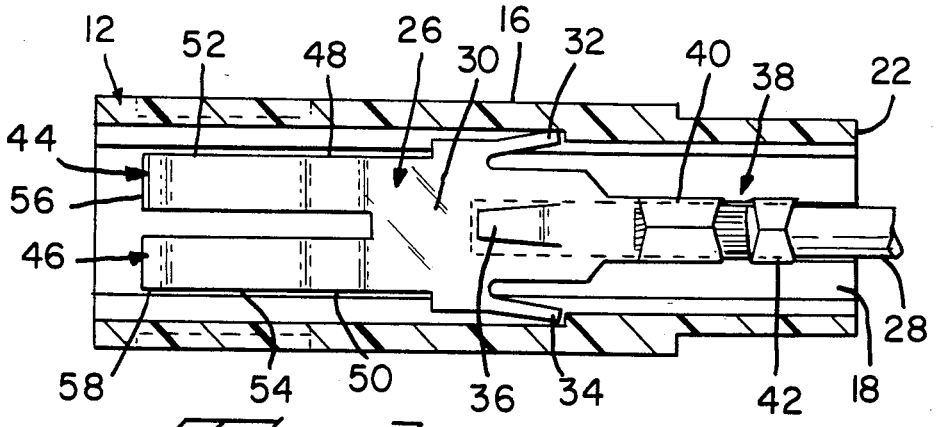
FIG. 3 is a longitudinal section taken along line 3—3 of FIG. 2.

A representative electrical connector 10 has been shown in the Figures. This connector 10 has a plug portion 12 and a receptacle portion 14 which embody the subject invention. The plug 12 has an elongated housing of rigid insulative material 16 having an axial bore 18 extending from a front mating face 20 to a rear surface 22. The outside of the housing 16 is profiled at 24 for a bayonet engagement in the receptacle 14. The subject terminal 26 is secured to one end of a conductor 28 and comprises a body 30 having a pair of tines 32, 34 extending outwardly in the plane of the body, a locking lance 36 extending from the plane of the body, and a conductor engaging portion 38 including a first pair of wire engaging arms 40 and a second pair of insulation engaging arms 42. The mating end of the terminal is formed by a pair of cantilever arms 44, 46 each having an initial portion 48, 50 extending at an angle in opposite directions from the body 30. Second portions 52, 54 are oppositely inclined from the first portions and extend at least to the plane of the body 30. The end portions 56, 58 are reversedly curled to form a smooth surface of transition at the leading end of the terminal.

The receptacle 14 is formed by a two-piece housing 60, 62 of rigid insulative material defining at least one plug receiving cavity 64 and a terminal passage 66 opening into said cavity. The housing is secured together by any known means 68. The receptacle terminal 70 is essentially a planar member having a blade portion 72 with a pair of oppositely directed embossments 74, 76 spaced from the free end thereof and at least one blade portion 78 adapted to be engaged with a further conductor or connector (not shown).

The present invention is assembled by first terminating the respective conductors 28 by crimping the terminals 26 on the end thereof. The terminal 26 is then inserted in the bore 18 of a plug 16 and properly seated therein. Tines 32, 34 serve to stabilize the terminal and lance 36 to secure it in place. The receptacle 14 is assembled by simply placing the terminal 70 between the housing members 60, 62 and securing the assembly together by means 68.

Figure 6B:
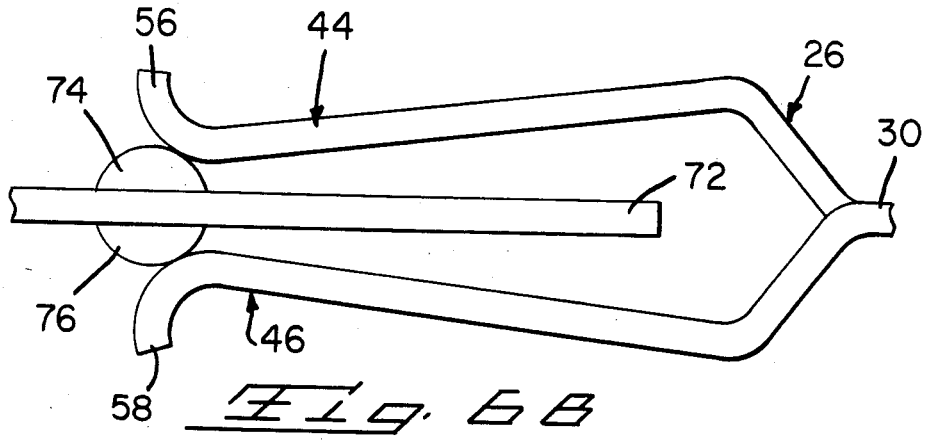
FIG. 6B is a side elevation of the subject invention in the condition of FIG. 6A.
Figure 7B:
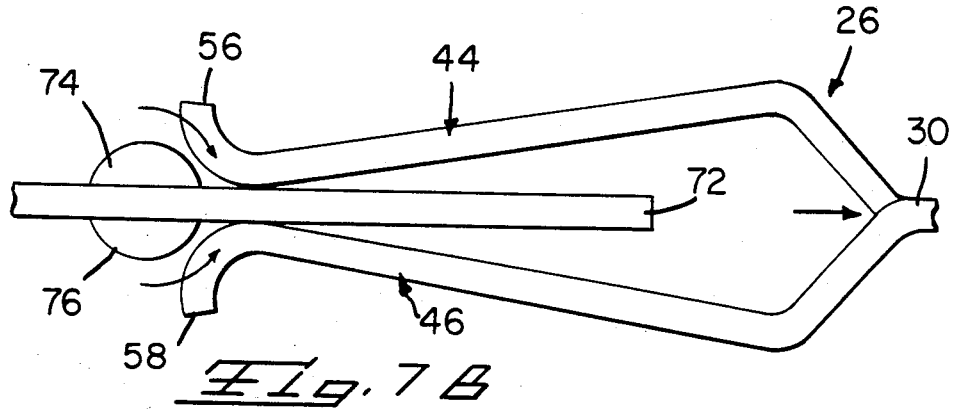
FIG. 7B is a side elevation of the subject invention in the condition of FIG. 7A.

The operation of the present invention will be most clearly understood from FIGS. 4, 5, 6A, 6B, 7A and 7B. FIG. 4 shows the terminals 26, 70 in an aligned and unmated condition. It will be noted that the planes of the terminals 26, 70 are substantially at right angles to each other. The plug terminal 26 is brought together with the receptacle terminal 70, as shown in FIG. 5, with the legs 44, 46 thereof overlying the opposite sides of the blade 72. It will be noted also that the free ends 56, 58 of the legs 44, 46 are positioned above and between the embossments 74, 76 of the blade 72. The plug terminal 26 is then rotated about its longitudinal axis, clockwise in the present instance, to bring the free ends 56, 58 into engagement with the respective embossments 74, 76. This is best understood from FIGS. 6A and 6B. It will be seen from these Figures that the legs 44, 46 of the plug terminal 26 are put under load and slightly spread so that there is a resilient force tending to drive the plug terminal 26 in an unmating direction. Releasing the insertion force from the plug terminal 26 allows the legs 44, 46 of the terminal 26 to move towards a relaxed normal position, driving the terminal 26, in an unmated direction off of the embossments, as shwon in FIGS. 7A and 7B. This creates a wiping action to assure good electrical continuity between the terminals 26, 70.

The present invention has been illustrated with an electrical connector of the bayonet type, the latching features of which are so well-known that they will not be described with any detail. It will be appreciated that this form of connector especially benefits from the present invention in that there is the substantial absence of mating force and yet a wiping effect is achieved.

I claim:

1. A pair of zero mating force electrical terminals having a wiping action, said pair of terminals comprising:

a first terminal having a planar blade portion with oppositely directed embossments uniformly spaced from a free end of said blade portion; and a second terminal formed with a planar body having integral conductor engaging means at one end thereof and mating means at the opposite end thereof, said mating means comprising a pair of cantilever beam arms, said terminals being initially mated with their planes normal to each other and then being relatively rotated about their longitudinal axes to bring the free ends of said arms into engagement with said embossments under load, the second terminal then being released whereby the arms thereof drive towards a normal relaxed condition effecting a wiping action on said embossments.

2. A pair of zero mating force electrical terminals according to claim 1 wherein each arm of said second terminal has an initial portion extending from said body oppositely angled to either side of the plane of said body, an intermediate portion reversedly angled with respect to the first portion, and a free end portion reversedly curved to form a smooth surface of transition.

3. A pair of zero mating force electrical terminals according to claim 1 wherein said conductor engaging means of said second terminal comprises a crimp barrel.

4. A pair of zero mating force electrical terminals according to claim 1 wherein said first terminal further comprises mating means.

5. A low mating force electrical connector having wiping action comprising:

a receptacle member having a housing of insulative material and defining a plug receiving cavity therein;

a first terminal mounted in said receptacle housing with a blade portion extending into said cavity, a pair of oppositely directed embossments on said blade portion spaced from a free end thereof;

a plug member having a housing of insulative material with an outer profile adapted to be received in said receptacle cavity and having an axial bore; and a second terminal having a body portion with an integral conductor engaging portion extending from one end and a pair of profiled cantilever arms extending from the opposite end, said second terminal being received in said axial bore of said plug member;

said plug member initially mating in said receptacle member with the planes of said first and second terminals normal to each other and said arms overlying between said embossments, said plug member being rotated about its axis to bring said arms into loaded engagement with said embossments, said plug member being released whereby said arms drive to a normal relaxed condition causing wipe between said terminals.

6. A low mating force electrical connector according to claim 5 wherein said receptacle member has a plurality of plug receiving cavities.

7. A low mating force electrical connector according to claim 6 wherein at least one first terminal is provided with blade portions in each said plug receiving cavity.

8. A low mating force electrical connector according to claim 5 further comprising bayonet coupling means between said plug member and said receptacle member.

9. A low mating force electrical connector according to claim 5 wherein said second terminal is a stamped and formed member having a latching lug.

10. A low mating force electrical connector according to claim 5 wherein said second terminal is a stamped and formed member having stabilizing tines extending from and in the plane of said body.

11. A low mating force electrical connector according to claim 5 wherein said conductor engaging portion comprises a crimp barrel.

12. A low mating force electrical connector according to claim 5 wherein said conductor engaging portion comprises a first pair of wire crimp ears and a second pair of insulation crimp ears.

13. A low mating force electrical connector according to claim 5 wherein each said arm of said second terminal has an initial portion extending from said body portion oppositely angled to either side of the plane of said body portion, an intermediate portion reversedly angled with respect to the first portion to approach the plane of said body portion, and a free end portion reversedly curved to form a smooth surface of trasition.

14. A low mating force electrical connector according to claim 5 wherein said first terminal further comprises mating means.

* * * * *